United States Patent [19]

Brewer et al.

[11] 4,038,032

[45] July 26, 1977

[54] METHOD AND MEANS FOR CONTROLLING THE INCINERATION OF WASTE

[75] Inventors: Gerald L. Brewer, Rowayton, Conn.; Steven D. Olsen, New Rochelle, N.Y.

[73] Assignee: UOP Inc., Des Plaines, Ill.

[21] Appl. No.: 641,126

[22] Filed: Dec. 15, 1975

[51] Int. Cl.[2] ..... F23G 7/06

[52] U.S. Cl. ..... 23/230 A; 23/232 R; 23/253 A; 23/254 R; 23/277 C; 110/8 A

[58] Field of Search ..... 23/230 A, 253 A, 230 PC, 23/253 PC, 277 C, 232 R, 232 E, 255 R, 255 E, 254 R, 254 E; 110/8 R, 8 A, 72 B, 101 CA

[56] References Cited

U.S. PATENT DOCUMENTS

| | | | |
|---|---|---|---|
| 2,762,568 | 9/1956 | Sullivan | 23/253 A |
| 3,243,116 | 3/1966 | Dijt et al. | 23/253 A |
| 3,868,779 | 3/1975 | Wilt, Jr. et al. | 110/8 A |

*Primary Examiner*—R.E. Serwin

*Attorney, Agent, or Firm*—James R. Hoatson, Jr.; Philip T. Liggett; William H. Page, II

[57] ABSTRACT

A control system for the incineration of pollutants in waste gases which will conserve fuel consumption and which embodies feed back signals from temperature sensing means and/or gas analyzing means in connection with the combustion gases to detect an undesired temperature deviation from a control temperature or, alternatively, detect excessive unburned pollutants and utilize optimizing-controller means to receive the resulting output signals and, in turn, provide incremental control changes to effect a change in the temperature control level and the incremental stepping down or stepping up of a set point for the control of fuel flow to the heat supplying burner of the incineration zone.

5 Claims; 1 Drawing Figure

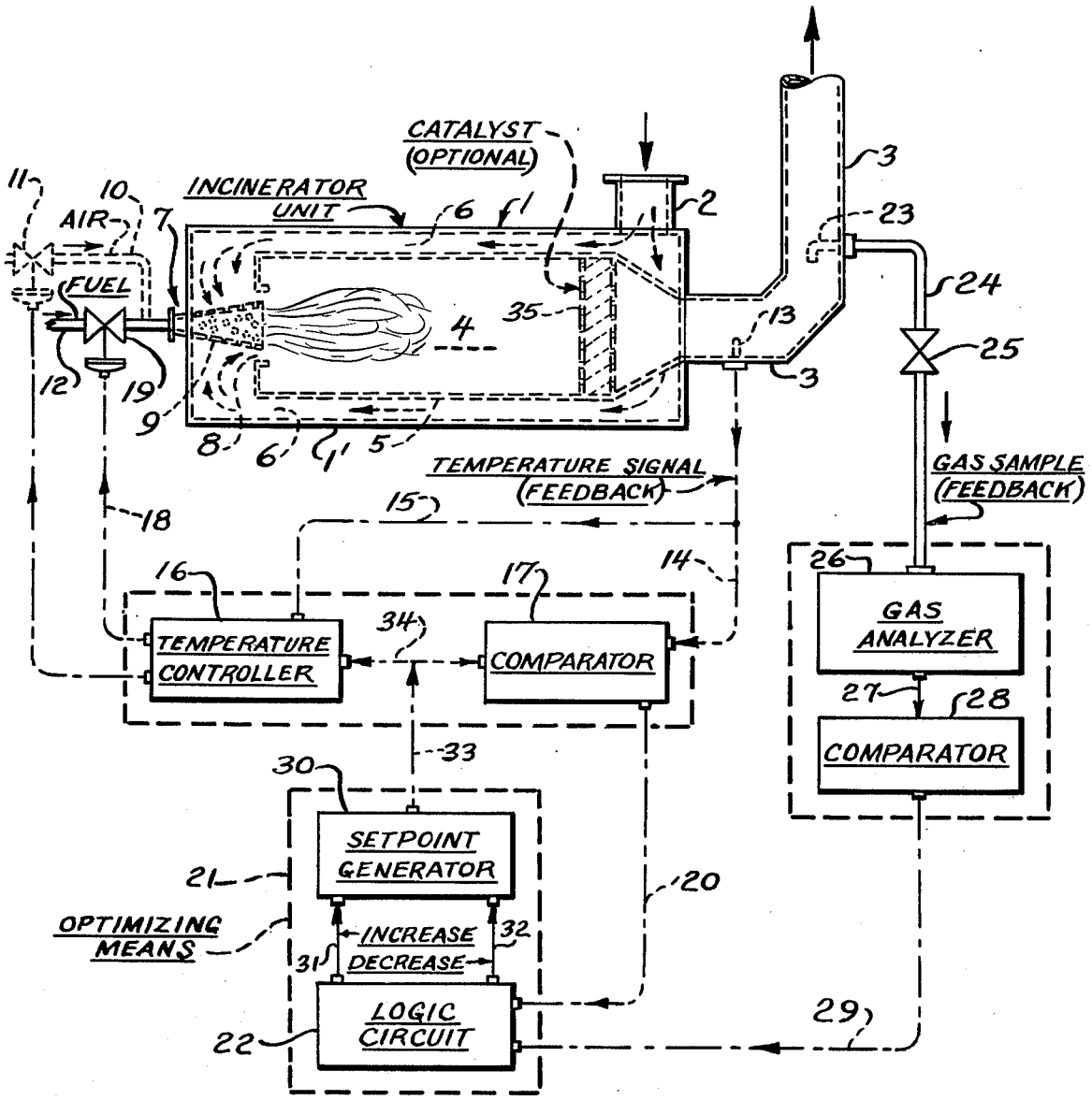
CATALYST (OPTIONAL)
INCINERATOR UNIT
AIR
FUEL
TEMPERATURE SIGNAL (FEEDBACK)
GAS SAMPLE (FEEDBACK)
TEMPERATURE CONTROLLER
COMPARATOR
GAS ANALYZER
COMPARATOR
SETPOINT GENERATOR
OPTIMIZING MEANS
INCREASE
DECREASE
LOGIC CIRCUIT

METHOD AND MEANS FOR CONTROLLING THE INCINERATION OF WASTE

The present invention relates to an improved method and means for effecting the control of incineration operations.

More particularly, the invention is directed to a method for automatically controlling an incinerator for waste gas streams to effect the conservation of fuel input to the burner for the incineration zone.

In operating both thermal and catalytic incinerator systems, it is realized that various control means have been utilized, particularly from safety aspects; however, it is believed novel to incorporate the means to automatically optimize an operating control temperature at substantially the lowest practical level for maintaining a stable operation and assuring cleanup of the waste exhaust gases at minimum fuel input.

It should also be pointed out that in the operation of any incineration system where combustible pollutants are involved, and for reasons of safety, it is necessary to limit the combustion operation so that the mixture of flammable vapor or gas in air (usually expressed as a percent by volume) is well below the explosive level or where a flame will travel if the mixture ignited. Specifically, it is the practice to maintain a mixture which is only 25% to 30%, or preferably lower, of the lower explosive limit (L.E.L.). In a further aspect of incineration unit control, since inlet temperatures and average combustion chamber temperatures are difficult to measure and use as a control means, it is the practice to effect overall control from measuring the temperature of the combustion gases leaving the incineration zone and utilize it as the system control. However, from the fuel economy aspect, it is undesirable to have to maintain a given high temperature level just to insure a guaranteed high conversion for a maximum loading of entrained combustibles in the exhaust gas stream. Thus, it can be of particular advantage, in accordance with the present invention, to provide for a lowering of the outlet temperature, or "control temperature," for conditions of less than the maximum loading of combustibles. For example, where a stream mixture containing 13 BTU per SCF of flow is being oxidized in an operation with a 1600° F. control temperature and there is 700° F. rise from a 900° F. gas inlet temperature, there is an average temperature in the reaction chamber of 1250° F. However, if the combustibles concentration in the inlet gas stream falls by 50 percent, then there are only 6½ BTU per SCF and with the 1600° outlet or control temperature there is necessarily an inlet temperature of 1250° F. and an average temperature in the combustion zone of 1425° F. This high temperature level is, of course, wasteful from the fuel consumption aspect and indicates a need to be able to adjust the control temperature downwardly.

In the majority of the thermal and catalytic incineration operations there is oxidation of combustible fumes in a waste gas stream; however, there may be instances of odor and fume control necessary for waste gas stream where pollutants such as oxides of nitrogen ($NO_x$) are present which must be burned in a reducing atmosphere.

It may thus be considered a principal object of the present invention to provide a control system in combination with an incineration unit suitable to burn any type of pollutants in a waste gas stream and which will provide a method for adjusting an outlet control temperature responsive to varying concentrations of a pollutant in the gas stream to be oxidized so as to conserve fuel consumption in the unit.

In effecting the lowering of temperature control, there is, of course, the danger that the inlet temperature will get too low and the desired thermal reaction becomes unstable and there is a resulting excessively low conversion of combustibles. Where a control system excessively increases the fuel input and the burner firing rate, the inlet temperature can climb to maintain outlet temperature but, in addition, can over shoot the desired control point. Thus, in an additional aspect, it is another object of the present invention to provide a control system embodying a method of incrementally adjusting fuel input responsive to deviation from a control set point.

Inasmuch as the efficiency of a thermal incineration system can be measured by measuring the amount of combustibles or other pollutant remaining in the outlet stream from the system, it is also an object of the invention, and within the scope thereof, to provide for effecting incremental changes in a control level responsive to signals which are, in turn, provided from an analysis of pollutant concentrations remaining in the outlet stream.

In a broad embodiment of the present invention for effecting the incineratin of undesired waste gaseous materials, the improved method for adjusting and conserving fuel input to the burner for the incineration zone responsive to changes in the quantity of pollutants content of the waste gas stream being introduced to the incineration zone which comprises: (a) a fuel flow control means operating responsive to process feed back and set point signals, (b) measuring a change in the combustion zone stream leaving the incineration zone, (c) sending an output signal to a set point optimizing means indicative of a change in the combustion gas stream, (d) comparing a feed back signal with at least one predetermined set point level in said optimizing means and generating a signal for a set point change responsive to a differential from the predetermined set point level to make an incremental change in such level, and regulate said fuel flow control means to change fuel flow to the burner, whereby fuel input can be decreased for an above normal temperature level and, conversely, increased for conditions of excessive pollutants in the waste gas stream and for a low temperature unstable reaction in the incineration zone.

Actually, in effecting the measurement of a change in the combustion product stream leaving the incineration zone, there may be utilized temperature sensing means so as to provide an output signal to the controller means which will show a deviation from a control set point. In a parallel arrangement to the temperature sensing of the treated gas stream, there is a feed back as to the residual pollutants content by using an analyzer means, such as a combustibles detector, a chromatograph, or other analyzing means suitable to indicate the presence of combustible products for the particular exhaust gas stream, and the measurement of the quantity of pollutants to compare with a control level and to indicate a deviation from a desired standard. For example, if there are excessive unburned pollutants remaining in the treated gas stream, there is the indication that a higher temperature level will be required in the combustion zone and incremental changes thereby necessary to raise the control temperature. Thus, as will be explained in connection with the description of the drawing, there can be set point control from both gas stream analysis and from temperature feed back analysis.

In another embodiment of the invention, as directed to the overall apparatus system, there is provided in combination with an incinerator unit having a regulatable fuel supply to the burner means thereof for eliminating pollutants in a waste gas stream to be passed through the combustion section of the incinerator unit, an improved control system which will maintain a desired minimum conversion level and, in addition, will conserve fuel consumption responsive to changes in the quantity of pollutants in the waste gas stream, which comprises: (a) an adjustable set point flow control means for fuel supply to the burner of the unit operating responsive to changes in set point and process feed back signal, (b) at least one signal producing-sensing means at the combustion gas outlet from the incineration unit to show a change in the combustion gases, (c) an optimizing means connecting to said signal producing-sensing means which will compare received signals with a prior determined level and provide an incremental step-up or step-down adjustment of the control set point level for said adjustable flow control means.

Again, it is to be pointed out that the signal producing-sensing means utilized for the combustion products stream may comprise temperature sensing means and/or gas analyzing means in order to provide a signal to compare with a predetermined control level. Actually, a control system could utilize both types of sensing which will operate in parallel to provide output signals to the optimizing-controller means. In other words, a temperature indication from temperature sensing means will provide scanning for a temperature differential by means of a comparator while the output signal from the gas analyzer means will provide for a determination as to whether a predetermined level of pollutants permissible in the combustion gas output stream has been exceeded. The optimizer means will also include time delay means for the output signal therefrom to effect set point changes in the flow controller means for the fuel input to the burner for the combustion zone such that each control level change and fuel input change will have time to stabilize the combustion zone.

The present invention may be better explained and understood by reference to the accompanying diagrammatic drawing and the following description thereof.

Referring now particularly to the drawing, there is indicated one type of incinerator unit 1 which is indicated as having an outer housing 1' with a waste gas inlet 2 and a combustion gas outlet section 3. In addition, for the particular embodiment shown, there is indicated an internal combustion zone 4 defined by an internal wall 5 which is spaced inwardly from the external housing to, in turn, define a gas flow path 6 for the waste gas stream being introduced by way of inlet 2. The waste gas stream will flow in heat exchange relationship with the exterior of the wall 5 defining combustion zone 4 and then carry to an end portion of the housing 1' where it will encompass the burner means 7 to in turn pass in an annular passageway zone 8 to reach the interior of the unit indicated as the combustion zone 4. In a preferred arrangement, the burner means 7 will be of the "100% secondary air" type of operation where a portion of the waste gas stream can flow through perforations in a perforated cone 9 to commingle with the fuel and, in effect, provide the primary air to mix with the fuel and produce flame and hot combustion gases downstream from the burner means 7 to result in the desired thermal incineration of the combustibles in the remaining portion of the waste gas stream being introduced into the incineration zone 4 through passageway 8. The so-called "100% secondary air burning" is described and set forth in Hardison et al U.S. Pat. No. 3,484,189; however, in order that the present invention and overall control system is not limited to this type of burner arrangement, there may be primary air added to the burner and into admixture with the fuel as indicated by line 10 with control means 11 juncturing with fuel line 12 ahead of the burner means 7.

Although not shown in the present incinerator unit, it is within the scope of the present invention and particularly for thermal incinerators, to provide a hot recycle gas conduit, which can include a control damper means, to connect between the gas outlet duct 3 and the waste gas inlet duct 2. This arrangement provides for maintaining periodic or continuous recycle of a portion of a hot combustion gas product stream such that the combustion zone of the unit may be more rapidly brought up and maintained at a suitable operating temperature. Such an operation and the advantages are set forth in a Hardison U.S. Pat. No. 3,604,824.

In accordance with the present invention, there is indicated a temperature sensing means 13 within the outlet section 3 so as to provide feed back communication with the combustion gas stream leaving zone 4 and effect an output signal to carry through lines 14 and 15 to a temperature controller 16 and to a comparator means 17. The temperature controller 16 will be of a conventional type having an adjustable set point to be able to automatically regulate the burner 7, through line 18 and control valve 19, while the comparator means 17 will provide for receiving the feed back temperature signal to compare with an adjustable set point temperature or control level therein and in turn provide an output signal therefrom responsive to the feed back temperature being above or below the set point level and the temperature differential greater than a predetermined amount. The output signal from the comparator 17 carries by way of line 20 to an optimizing means 21 and in particular to the logic circuitry thereof, indicated diagrammatically as 22, to determine the need of an increase, or alternatively, a decrease in set point temperature for the incinerator operation.

It is also a feature of the present control system to provide a paralleling type of feed back arrangement which involves means for the continuous, or periodic, sampling of the incinerated gas stream, such as by way of sample pick-up means 23 and line 24, with valve 25, to carry to an analyzer means 26. The latter provides a signal through means 27 to a comparator means 28 such that there may be a determination as to the residual pollutants content, if any, remaining in the treated gas stream. Typically, a low reading, below a predetermined standard, will not call for a set point change in the system although, conversely, a high level of residual pollutants in the gas outlet will call for an increase of set point temperature to, in effect, override temperature feed back and thus insure the burning of pollutants to achieve a predetermined efficiency. The signal from comparator means 28 is carried by line 29 to the logic circuitry 22 such that the latter can make the proper determination as to the output signal to, in turn, be transmitted to a set point generator means at 30. For pictoral purposes, there is indicated that an "increase" signal will be transmitted by way of line 31 and a "decrease" signal sent by way of line 32. The set point change signal, as generated by means 30, is transmitted by line 33 to line 34 which, in turn, is connective with both the controller 16 and the comparator 17 such that new set point control temperature levels will be provided in each instance to the control means and thence to the operation of the burner 7.

Various types of automatic control equipment may be used in the present system. For example, the temperature controller could be of the Barber-Colman 520 Series, solid state analog or of the digital set point controller type. The Series 520 is a modular controller which can accept an output from a standard Barber-Colman thermocouple, resistance bulb, radiation pyrometer, or other millivolt source. Also various control modes can be made available, as for example, proportional, on-off, proportional plus integral (automatic reset) and plus derivative (rate). Deviation action and alarm are also available with the 520 Series controller. The Foxboro 62HF Series of Electronic Control Receivers provide an example of another type of control apparatus which can be used in the present type of system to combine the function of the comparator 17 and temperature controller 16 so as to provide the desired burner variations responsive to changes in temperature level control or set point level.

The specific type of equipment to be used within the control system is not critical and may be made to operate electrically, electromechanically, electro-pneumatically, pneumatically, digital electronically or analog electronically, etc. The components for the step-up and step-down means or for a seek mode type of control arrangement are all quite standard and commercially available for use with a programmable or logic controlled optimizing-controlling means. The optimizer-controller means as indicated at 21 will, of course, be adjusting output signals in order to improve performance of the unit and, at the same time, minimize fuel consumption. Reference may be made to pages 22–52 through 22–62 of Perry's Chemical Engineering Handbook, 4th Edition, published by McGraw-Hill Company, for a brief description of optimizer theory. There are various suppliers of different types of optimizers, and it is not intended to limit the invention to any one supplier or any one model. As an example, a Westinghouse Veritrak type of optimizer controller provides an analog computer that operates on the principal of introducing small output changes and noting the effect on an index or indices that it scans. Then by noting the effect, it can make a decision to change the output signals as necessary to approach an optimum performance of a conversion unit. Typically, the optimizer means will include computer or logic circuitry receiving digital signals and also transmitting digital signals to a set point generator means which will provide an analog output to the controller means. The set point generator means may, for example, also be of the Foxboro type of controller instrument which will be sending out analog output signals responsive to digital inputs.

There is, of course, suitable timer means built into the optimizer-controller means such that the changes as to fuel input to the system will have a time to become stabilized at the burner and in turn provide a suitable stabilized output of combustion gases prior to there being a successive scanning of the control lever or set point level and the determination as to whether there should be successive changes in the fuel input to the burner.

The gas analyzer means at 26 will be of a type compatible with the particular pollutant or residual combustible in the waste gas stream being charged to the incinerator. For example, a Bailey instrument, operating catalytically to provide a measure of "combustibles" present in a gas stream can be used for hydrocarbons, CO, etc. In the event of nitrogen oxides as pollutants, then there may be infrared spectrophotometry, microwave spectroscopy, etc. Typically, the analyzer means 26 will be sending an analog signal to the comparator 28 for the scanning operation therein and for a comparison of the input with a predetermined control level to insure adequate conversion or oxidation within the combustion zone 4.

OPERATION OF THE SYSTEM

In the start-up of the incinerator unit, fuel input and temperature will be elevated to reach a preset control temperature compatible with a predetermined analysis of the combustibles or pollutants in the waste gas stream in order to effect a desired oxidation and conversion level. Although not shown and heretofore described, it is to be noted that suitable automatic ramp generator means can be utilized as a part of, or in addition to, the overall control system. After reaching a predetermined high temperature control level, the system can then provide a timed step-down operation and effect periodic scannings of the feed back from the temperature sensing means such as at 17 and at optimizer means 21 so as to try for "decrease" signals to the set point generator means 30 and step-down set point levels to the controller 16 and comparator 17. The step-down procedures can continue until there is either a deviation with set point temperature which could indicate instability in the oxidizing reaction or until such time that the burner goes to a predetermined minimum turn-down. Along with the temperature sensing feed back, there can be the simultaneous gas sampling at 23 to provide an analysis at 26 to determine whether there may be a residual excessive level of combustibles, or pollutants generally, which will in turn preclude further step-down procedures. The step-down procedures will then be followed by incremental step-ups until such time that there is no excessive deviations from a predetermined residual pollutants level or from temperature set point levels in the controller-comparator means.

The temperature level at the sensor 3 can, of course, change in response to burner turn-down or from the presence of a reduced quantity of combustibles being present in the waste gas stream to the incinerator. Should there be a decrease in the quantity of combustibles in the waste gas stream during the operation of the unit, there will, of course, be a sensing of feed back temperature deviation and the controller 16 will respond by providing an increase in fuel flow through valve means 19 so as to increase the heat output of the burner to the combustion zone 4. Conversely, where the combustibles in the waste gas stream are increasing, the signals to the optimizer-controller will result in the lowering of the flow control set point and the quantity of fuel being supplied to the burner means and to the combustion zone so as to conserve fuel. As noted hereinbefore, the temperature sensing output signal as one feed back and an analysis of pollutants concentrations, as a second simultaneous feed back, or alternative feed back, will be provided in a preferred system to insure both a fuel minimizing operation and a system insuring adequate elimination of process pollutants. As long as the operation does not affect a lower limit of conversion efficiency, the system will optimize to reach a lowest fuel input level consistent with staying above reaction instability.

While the foregoing descriptions, as to incineration unit and control system, has been primarily directed to a thermal incinerator type of operation, it is to be noted that the incinerator unit could well be of the catalytic type where oxidation of combustibles is primarily effected or enhanced by contact with the presence of an oxidizing catalyst. For example, as indicated diagrammatically in the downstream end of combustion zone 4 there can be a gas pervious bed of catalyst 35 to effect the substantially uniform contacting of a heated waste gas stream which will pass therethrough. The catalyst can be of the all metal type such as disclosed in the Suter et al. U.S. Pat. Nos. 2,658,742 and 2,720,494, or alternatively, there can be a particulate type of catalyst utilized such as where alumina pills or pellets are coated with a platinum group metal or a combination of platinum group metals. The catalyst surface may also comprise the use of coated honeycomb type substrates which will provide a large surface area per unit of volume or space in a converter unit. In any event, it is not intended to limit the incinerator unit to any specific design and construction nor to being totally thermal or totally catalytic.

In still another aspect, it is to be noted that the incinerator unit could be heated electrically, rather than by fuel input, and that an optimizing control system in accordance with the present invention used to advantage to minimize the energy input to the conversion zone of the unit.

We claim as our invention:

1. In a process for effecting the incineration of undesired waste gaseous materials, the improved method for automatically adjusting and conserving fuel input to the burner for the incineration zone responsive to changes in the quantity of pollutants content of the waste gas stream being introduced to the incineration zone which comprises:

a. a fuel flow control means operating responsive to process feedback and set point signals, b. measuring a change in the combustion zone stream leaving the incineration zone, c. sending an output signal to a set point optimizing means indicative of a change in the combustion gas stream, d. comparing a feed back signal with at least one predetermined set point level in said optimizing means and generating a signal for a set point change responsive to a differential from the predetermined set point level to make an incremental change in such level and regulate said fuel flow control means to change fuel flow to the burner, whereby fuel input can be decreased for an above normal temperature level and, conversely, increased for conditions of excessive pollutants in the waste gas stream and for a low temperature unstable reaction in the incineration zone, said feed back signal being indicative of a change in the temperature of the combustion gas stream and providing a change in a temperature set point level responsive to a temperature deviation.

2. The incineration operation of claim 1 further characterized in that the feed back signal indicative of a change in the combustion gas stream is provided responsive to a deviation in the amount of unburned pollutants present in the combustion gas stream.

3. In combination with an incinerator unit having a controlled fuel supply to the burner means thereof for burning pollutants in a waste gas stream to be passed through the combustion section of the unit, an improved control system which will automatically maintain a desired minimum conversion level and, in addition, will conserve fuel consumption responsive to changes in the quantity of pollutants in the waste gas stream, which comprises:

a. an adjustable set point flow control means for fuel supply to the burner of the unit which includes temperature sensing feed back and can operate responsive to changes in set point and process feed back signal, b. at least one signal producing-sensing means at the combustion gas outlet from the incineration unit to show a change in the combustion gases, c. an optimizing means connecting to said signal producing-sensing means which will compare received signals with a prior determined level and provide an incremental step-up or step-down adjustment of the control set point level for said adjustable flow control means, said signal producing-sensing means comprising a temperature sensor providing an output signal to said optimizing-controller means.

4. The control system for an incinerator unit as set forth in claim 3 further characterized in that the signal producing-sensing means will comprise an analyzer means measuring pollutant concentrations in the combustion gases leaving the combustion section.

5. The control system for an incinerator unit as set forth in claim 3 further characterized in that signal producing sensing means will comprise both a temperature sensor means and analyzer means to provide signals responsive to a measure of pollutant concentrations in the combustion gases leaving the combustion section.

* * * * *